US010598322B2

(12) United States Patent
Holscher et al.

(10) Patent No.: US 10,598,322 B2
(45) Date of Patent: Mar. 24, 2020

(54) HIGH-BAY LUMINAIRE

(71) Applicant: Hubbell Incorporated, Shelton, CT (US)

(72) Inventors: Thomas Christopher Holscher, Simpsonville, SC (US); Joseph Daniel Engle, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 253 days.

(21) Appl. No.: 15/459,189

(22) Filed: Mar. 15, 2017

(65) Prior Publication Data

US 2017/0268737 A1 Sep. 21, 2017

Related U.S. Application Data

(60) Provisional application No. 62/308,508, filed on Mar. 15, 2016.

(51) Int. Cl.

| | |
|---|---|
| ***F21S 8/06*** | (2006.01) |
| ***F21V 15/01*** | (2006.01) |
| ***F21V 3/02*** | (2006.01) |
| ***F21V 23/06*** | (2006.01) |
| ***F21V 23/00*** | (2015.01) |
| ***F21V 17/06*** | (2006.01) |
| *F21W 131/40* | (2006.01) |
| *F21Y 115/10* | (2016.01) |

(52) U.S. Cl.

CPC ..... *F21S 8/063* (2013.01); *F21V 3/02* (2013.01); *F21V 15/01* (2013.01); *F21V 17/06* (2013.01); *F21V 23/002* (2013.01); *F21V 23/003* (2013.01); *F21V 23/06* (2013.01); *F21W 2131/40* (2013.01); *F21Y 2115/10* (2016.08)

(58) Field of Classification Search

CPC .. F21S 8/063; F21V 3/02; F21V 15/01; F21V 17/06; F21V 23/002; F21V 23/003; F21V 23/06; F21Y 2115/10; F21W 2131/40

USPC ..... 362/311.06

See application file for complete search history.

(56) References Cited

U.S. PATENT DOCUMENTS

| | | | |
|---|---|---|---|
| D106,281 | S | 10/1937 | Browne |
| 4,241,393 | A | 12/1980 | Olson |
| 4,698,735 | A | 10/1987 | Hirono |
| D328,148 | S | 7/1992 | Waldmann |
| 5,142,467 | A | 8/1992 | Yuen |
| D343,917 | S | 2/1994 | Yuen |

(Continued)

OTHER PUBLICATIONS

Hubbell Food Processing LED Highbay-FPH Series luminaire. Presented in Business Wire article dated Aug. 25, 2015. Found at businesswire.com visited Sep. 6, 2016 (2 pages).

*Primary Examiner* — Anh T Mai
*Assistant Examiner* — Hana S Featherly
(74) *Attorney, Agent, or Firm* — Michael Best & Friedrich, LLP

(57) ABSTRACT

A luminaire having a substantially two-piece housing with a first portion and a second portion, for example a cover and a base. The cover receives one or more control components. The base receives a light emitter assembly and the control component assembly is operatively connected to the lighter emitter assembly to control the light output therefrom. A lens assembly can be connected to the bottom of the base 14. Different mounting components can be connected to cover to connect the luminaire 10 to a support.

20 Claims, 8 Drawing Sheets

(56) References Cited

U.S. PATENT DOCUMENTS

| | | | | |
|---|---|---|---|---|
| D468,472 | S | 1/2003 | Mullally | |
| D596,765 | S | 7/2009 | Chiu | |
| D602,191 | S | 10/2009 | Chang | |
| 7,611,264 | B1 | 11/2009 | Chang | |
| D631,582 | S | 1/2011 | Hwang | |
| D642,300 | S | 7/2011 | Leung | |
| D642,316 | S | 7/2011 | Zheng | |
| D651,735 | S | 1/2012 | Dai | |
| D657,088 | S | 4/2012 | Miro | |
| D701,333 | S | 3/2014 | Wen | |
| 8,985,816 | B2 * | 3/2015 | Guercio | F21S 8/04 362/147 |
| D739,587 | S | 9/2015 | Largent | |
| 2009/0257234 | A1 | 10/2009 | Zheng | |
| 2010/0328956 | A1 | 12/2010 | Zhang | |

* cited by examiner

HIGH-BAY LUMINAIRE

RELATED APPLICATION

This application is based on U.S. Provisional Application Ser. No. 62/308,508, filed Mar. 15, 2016, the disclosures of which is incorporated herein by reference in its entirety and to which priority is claimed.

FIELD

Various exemplary embodiments relate to light fixtures or luminaires, for example indoor luminaires used in commercial or industrial applications.

BACKGROUND

Light fixtures, or luminaires, are used with electric light sources to provide an aesthetic and functional housing in both interior and exterior lighting applications. For example, high bay luminaires can be used in larger open indoor environments such as heavy industrial settings, warehouses, gyms, churches, and shopping malls.

Conventional high bay lighting fixtures for commercial and industrial applications are often mounted or suspended from ceiling joists high above the floor. Due to their location, mounting the luminaires and repair and replacement of parts, including light emitters and ballast components can be difficult.

SUMMARY

According to an exemplary embodiment, a luminaire includes a cover having an outer wall, a first set of corrugations, and an interior recess. A control component is positioned in the interior recess. A base is connected to the cover, the base having a second set of corrugations corresponding to the first set of corrugations. The base and cover form a housing. A light emitter is connected to the base and operatively connected to the control component. One or more mounting components connect the housing to a support.

According to another exemplary embodiment, a luminaire includes a cover having an outer wall and a first set of corrugations. A base includes a second set of corrugations corresponding to the first set of corrugations, a recessed first portion, a second portion opposite the first portion, and an opening providing communication between the first portion and the second portion. The base and cover form a housing. A control component positioned in the housing and a light emitter is connected to the base second portion. A conductor extends through the opening and operatively connecting the light emitter to the control component.

According to another exemplary embodiment, a luminaire includes a cover having an outer wall and a first set of corrugations. A base is connected to the cover having a second set of corrugations corresponding to the first set of corrugations. The base and cover forming a housing. A control component is positioned in the housing. A light emitter is connected to the base and operatively connected to the control component. A lens assembly includes a lens and a lens mount connecting the lens to the base. The lens mount is configured to connect to the base in a first orientation for connecting a first style of lens and to connect to the base in a second orientation for connecting a second style of lens.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
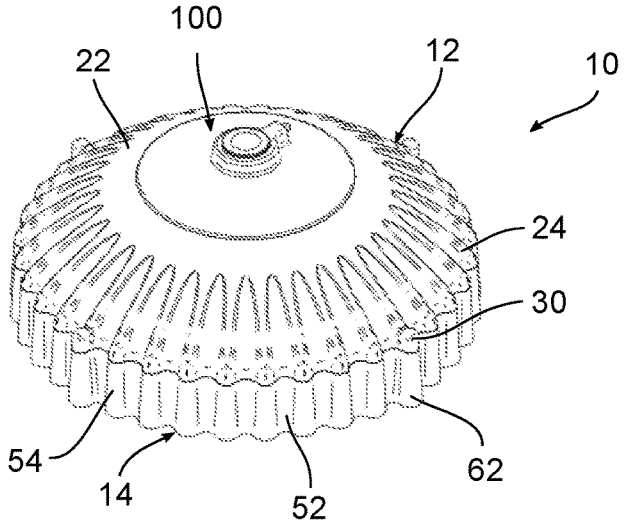
FIG. 1 is a perspective view of an exemplary luminaire.
Figure 2:
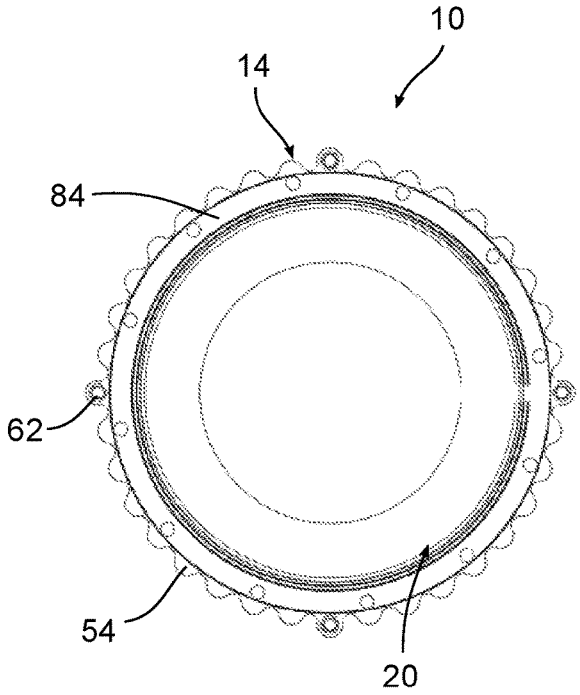
FIG. 2 is a bottom view of the luminaire of FIG. 1.
Figure 3:
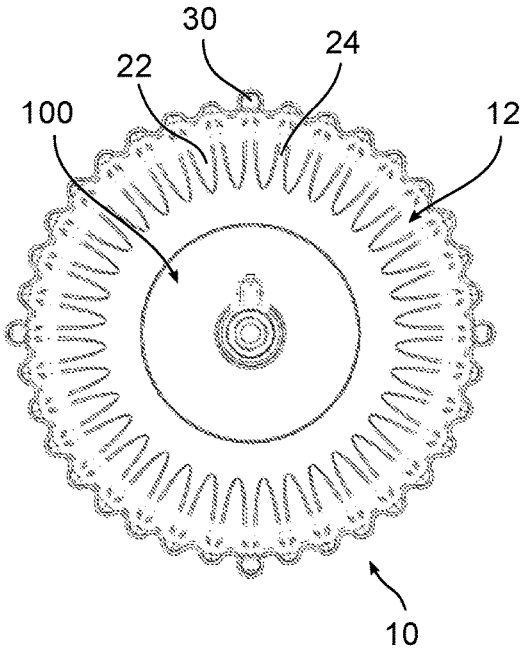
FIG. 3 is a top view of the luminaire of FIG. 1.
Figure 4:
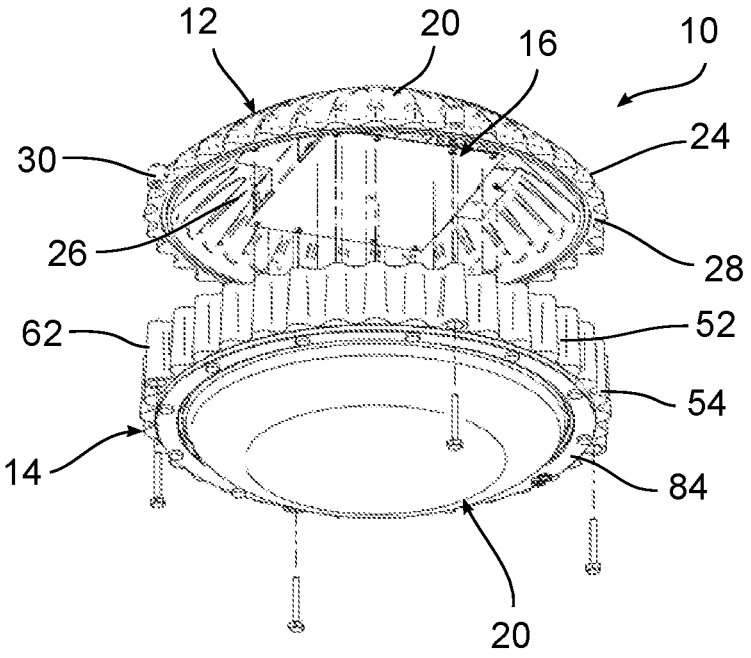
FIG. 4 is a partially exploded view of the luminaire of FIG. 1.
Figure 5:
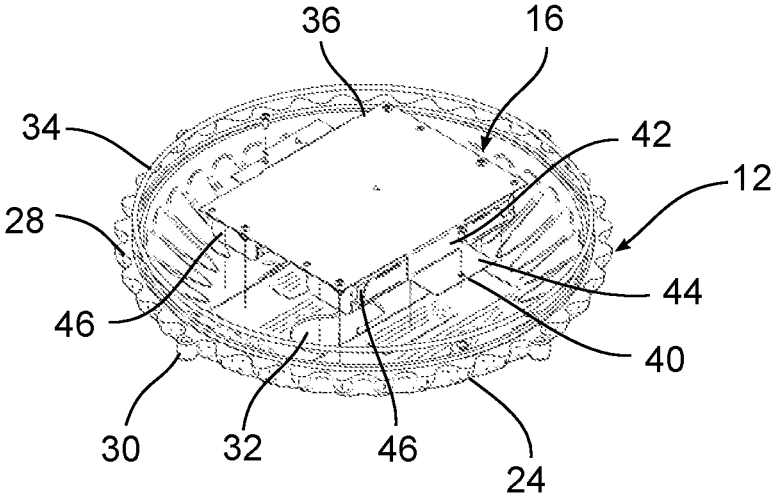
FIG. 5 is a perspective view of the bottom of the cover and control components of the luminaire of FIG. 1.
Figure 10:
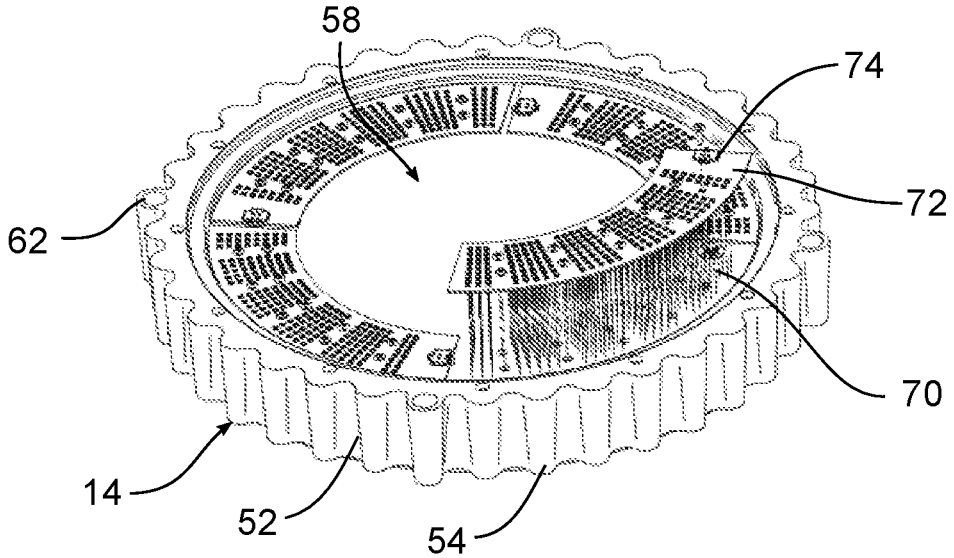
FIG. 10 is a bottom-perspective view of a second portion of the luminaire base of FIG. 1.

Various exemplary embodiments are directed to a bay luminaire 10 having a substantially two-piece housing with a first portion and a second portion, for example shown as a cover 12 and a base 14 in FIGS. 1-4. The cover 12 receives one or more control components that can be arranged as a control component assembly 16 as shown in FIGS. 4 and 5. The base 14 receives a light emitter assembly 18 as shown in FIG. 10 and the control component assembly 16 is operatively connected to the lighter emitter assembly 18 to control the light output therefrom. A lens assembly 20 can be connected to the bottom of the base 14 as shown in FIGS. 12-19. Different mounting components can be connected to cover 12 as shown in FIGS. 20-24 to connect the luminaire 10 to a support. The luminaire 10 can be water resistant and configured to be used in food processing applications.

Referring to FIGS. 1-5, the cover 12 has a substantially hemispherical configuration with an outer wall 22 and a first set of corrugations 24. The outer wall 22 at least partially defines an interior recess 26 that at least partially receives the control component assembly 16. The cover 12 also includes a rim 28 that is shown as the lower edge of the outer wall 22, although alternative configurations can include an interior or stepped rim 28. The rim 28 includes one or more connecting features, for example bosses 30 for receiving a fastener. The bosses 30 can be plain or threaded. As best shown in FIG. 5, an opening 32 is provided in the top of the cover 12 that can act as a mounting portion and can provide a conduit for conductors to enter the interior recess 26 and connect to the control component assembly 16. The opening 32 is shown as a keyhole slot, although other configurations can be used. A gasket 34 can be positioned between the cover 12 and the base 14 to form a seal.

FIGS. 4-8 show various exemplary embodiments of the control component assembly 16. The control component assembly 16 includes a bracket 36 having a mounting section 38 and one or more flanges 40 extending from the mounting section 38. First and second flanges 40 are shown in this example having an L-shape with a first portion 42 extending from the mounting section 38 and a second portion 44 extending at an angle to the first portion 42. The second portion 44 is spaced from, or non-planar to, the mounting section 36. This creates a recessed area that receives one or more control components. The bracket 36 includes mounting features for connecting various control components and for connecting the bracket 36 to the cover 12. In this embodiment the mounting features are shown as openings provided in the mounting section 38 and the flanges 40 that are configured to receive fasteners, although other structural features can be used including clips, projections, and snap features. As best shown in FIG. 5, the bracket 36 is connected to the cover 12 by one or more fasteners extending through the flanges 40.

Figure 6:
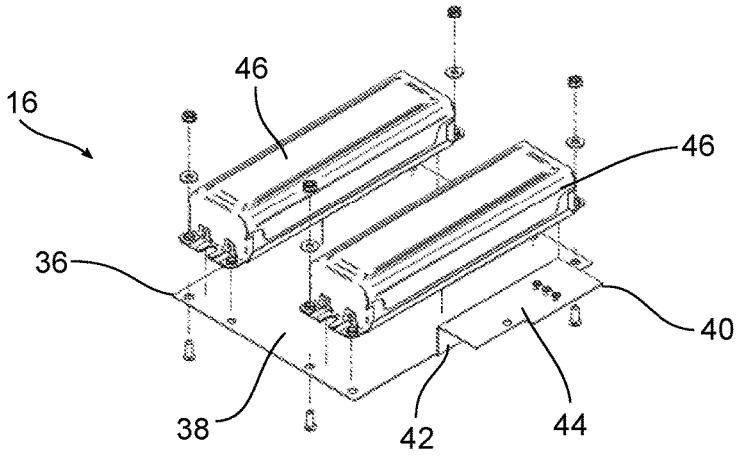
FIG. 6 is a bottom-perspective, exploded view of an exemplary control component assembly showing a bracket and a pair of drivers.
Figure 7:
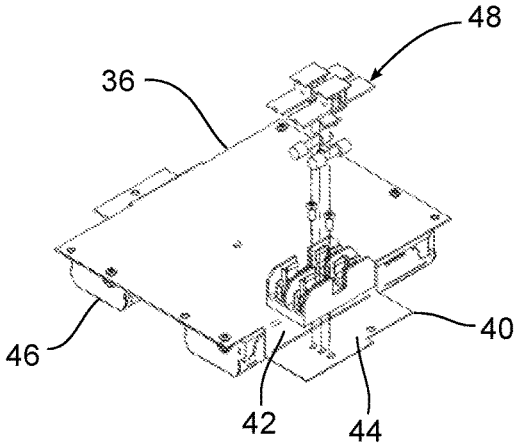
FIG. 7 is a bottom-perspective, partially exploded view of the control component assembly of FIG. 6 with a fuse assembly connected to the bracket.
Figure 8:
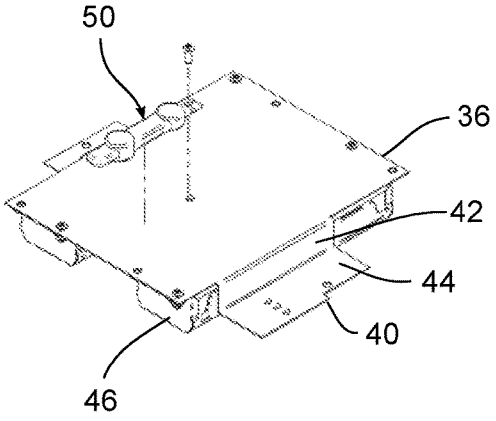
FIG. 8 is a bottom-perspective, partially exploded view of the control component assembly of FIG. 6 with a surge suppressor connected to the bracket.
Figure 11:
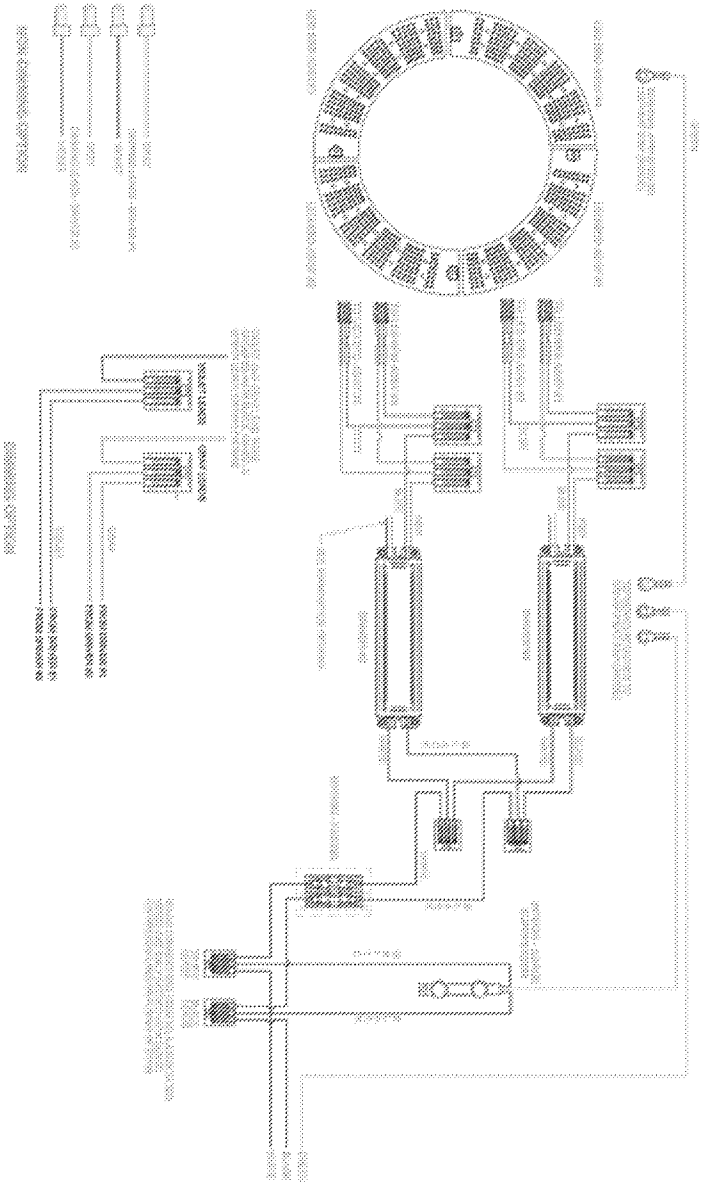
FIG. 11 is a schematic view of the luminaire and control components with and without an optional dimmer.

FIG. 6 shows a first driver 46A and a second driver 46B connected a first side of the mounting section 38 through a plurality of fasteners. One or more conductors can extend from the drivers 46A, 46B to connect to the light emitter assembly 18 as shown in the schematic of FIG. 11. FIG. 7 shows an exemplary embodiment of a double fuse assembly 48 that can be connected to the bracket 36 and associated with the drivers 46A, 46B. The double fuse assembly 48 is connected to one of the flanges 40 using fasteners. FIG. 8 shows a surge suppressor 50 that can be connected to a second side of the mounting section 38 of the bracket 36 and associated with the drivers 46A, 46B. Other control components, including different drivers, fuses, or surge protectors, as well as various types of sensors, can be associated with the luminaire, as would be understood by one of ordinary skill in the art. Alternative embodiments can also utilize fewer or more drivers.

FIGS. 1-3, 9, and 10 show an exemplary embodiment of the base 14 having a substantially cylindrical configuration with an outer wall 52 and a second set of corrugations 54 that align with the first set of corrugations 24. The cover 12 and base 14 combine to act as a heat sink to dissipate heat from the light emitters and the control components to the atmosphere. The first and second corrugations 24, 54 align to help to dissipate heat and to provide a smooth, uniform surface configuration that also allows for easy cleaning of the luminaire 10.

Figure 9:
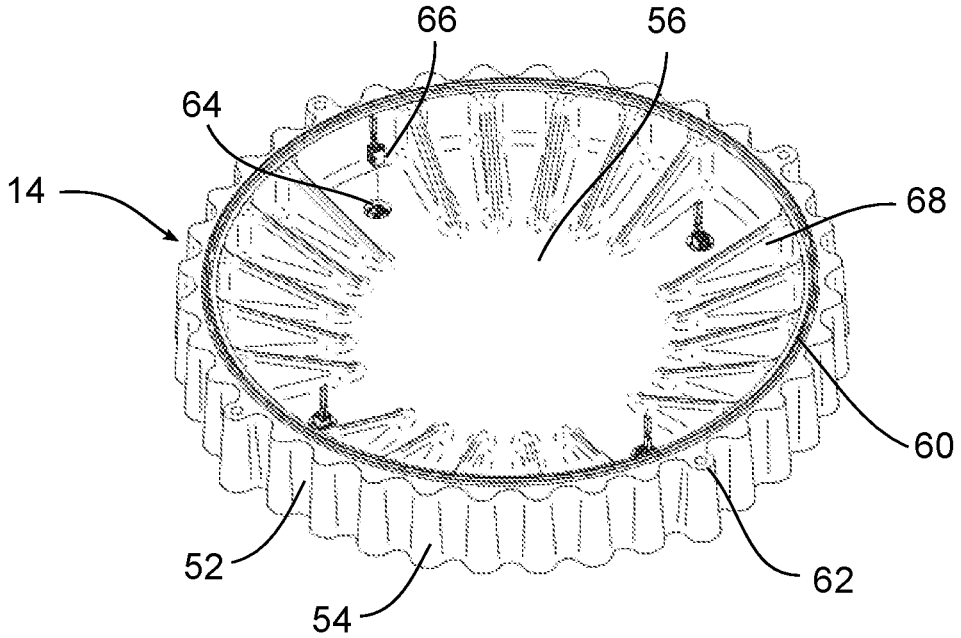
FIG. 9 is a bottom-perspective view of a first portion of the luminaire base of FIG. 1.

As best shown in FIG. 9, the base 14 includes a first portion 56 that faces the cover 12, a second portion 58 for receiving the light emitter assembly 18, and a rim 60 bounding the first and second portions 56, 58. The base 14 includes one or more connecting features, for example bosses 62 for receiving a fastener to connect the base 14 to the cover 12. The bosses 62 can be plain or threaded. The first portion 56 is recessed from an upper surface of the rim 60 to provide space for the control component assembly 16 and/or conductors connecting the control components to the light emitter assembly 18. One or more openings 64 provide communication between the first portion 56 and the second portion 58 to act as conduits for conductors or to otherwise operatively connect the control components to the light emitter assembly 18. In an exemplary embodiment, the conductors include one or more connectors 66, for example a power supply connector such as those made by WAGO®. One or more projections 68 extend from the first portion 56 to help transfer heat. The exemplary embodiment shows four sets of angled projections 68 extending in height towards the upper surface of the rim 60, although other configurations can be used.

As best shown in FIG. 10, the second portion 58 of the base 14 includes a mounting area 70 for receiving the light emitter assembly 18. The mounting area 70 includes openings for receiving fasteners to connect the light emitter assembly 18, although other connections can also be used. In this exemplary embodiment, the light emitter assembly 18 includes four curved LED boards 72 configured in a ring. The LED boards 72 include a printed circuit board with one or more LEDs and a connector 74. FIG. 11 shows an exemplary wiring diagram for the light emitter assembly 18 and the control component assembly 16 with and without a dimming option. Other sizes, shapes, configurations, and types of light emitters can also be used.

Figure 12:
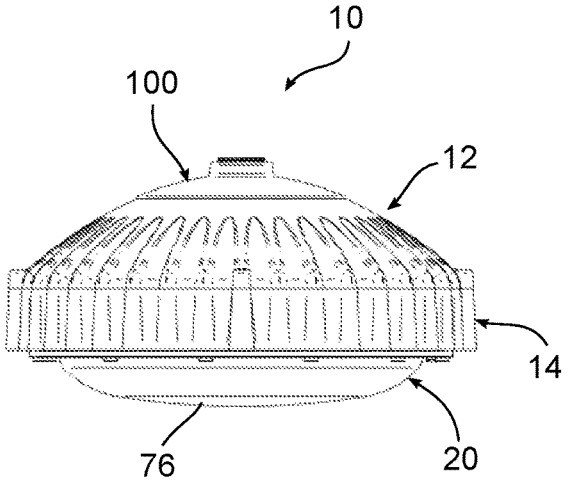
FIG. 12 is a side view of the luminaire of FIG. 1 with a SAG lens.
Figure 13:
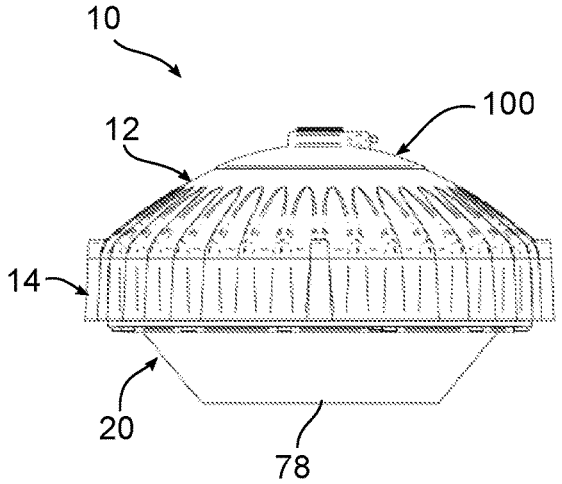
FIG. 13 is a side view of the luminaire of FIG. 1 with a drop lens.
Figure 14:
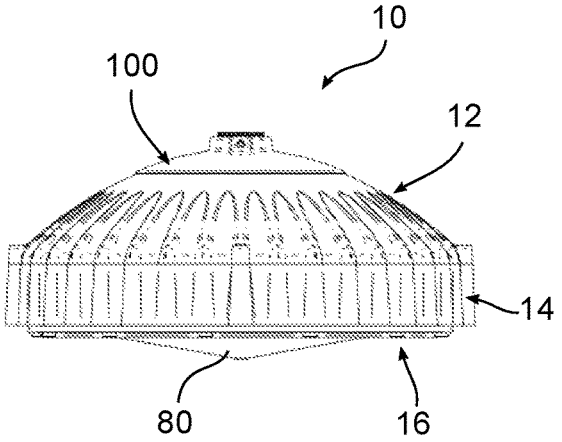
FIG. 14 is a side view of the luminaire of FIG. 1 with a conical drop lens.
Figure 15:
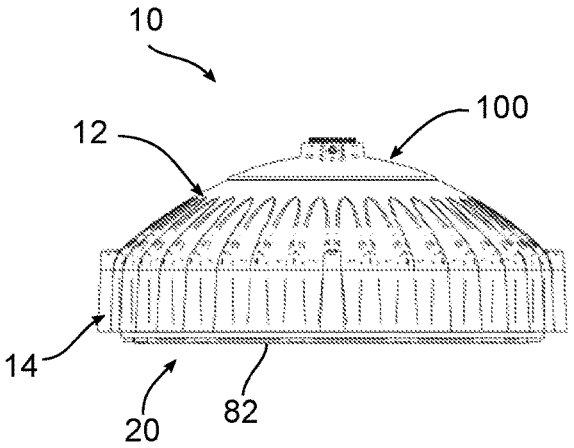
FIG. 15 is a side view of the luminaire of FIG. 1 with a flat lens.

According to an exemplary embodiment, a lens assembly 20 is connected to the base over the light emitters. FIGS. 12-15 show examples of different types of lenses that can be used with the luminaire. FIG. 12 shows a SAG lens 76, FIG. 13 shows a drop lens 78, FIG. 14 shows a conical drop lens 80, and FIG. 15 shows a flat lens 82.

Figure 16:
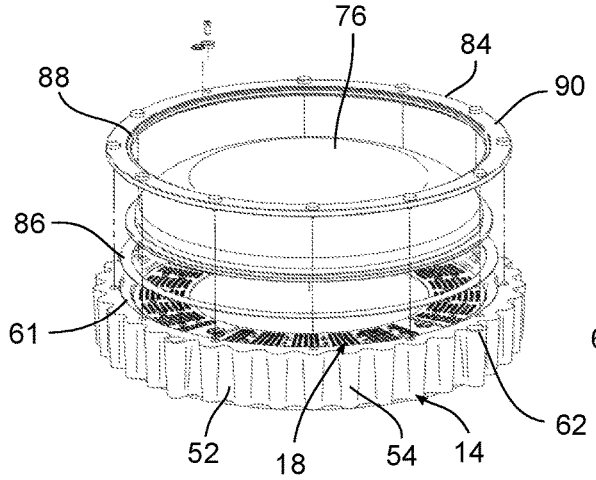
FIG. 16 is a bottom-perspective, exploded view of the base and lens assembly of FIG. 12.
Figure 17:
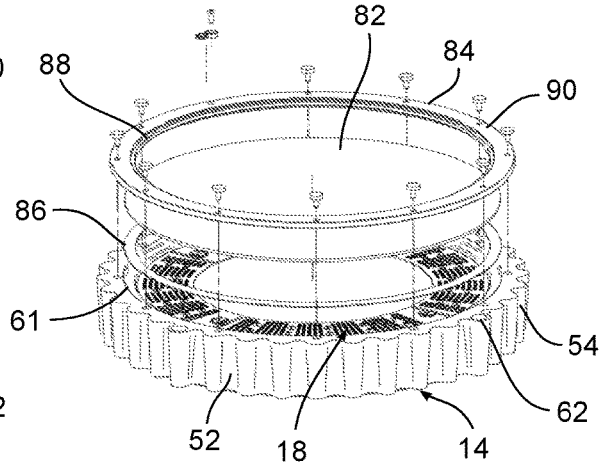
FIG. 17 is a bottom-perspective, exploded view of the base and lens assembly of FIG. 15.
Figure 18:
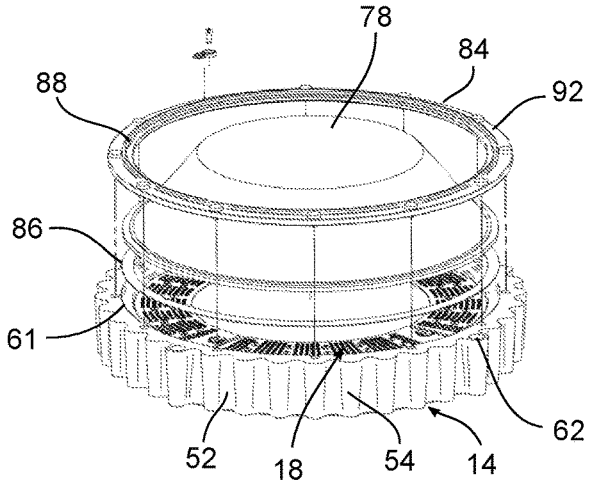
FIG. 18 is a bottom-perspective, exploded view of the base and lens assembly of FIG. 13.
Figure 19:
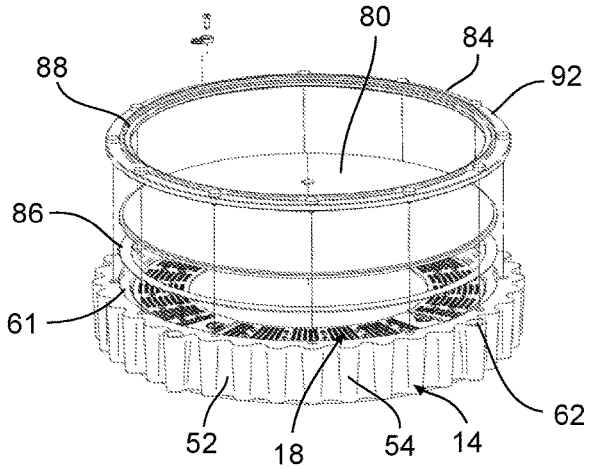
FIG. 19 is a bottom-perspective, exploded view of the base and lens assembly of FIG. 14.
Figure 20:
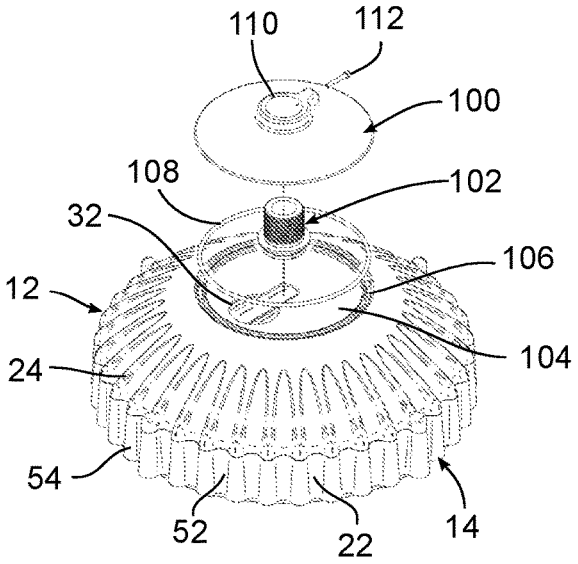
FIG. 20 is a bottom-perspective, exploded view of the luminaire and the mounting assembly.

FIGS. 16-19 show how the lenses can be mounted in the lens assembly 20. Referring to the exemplary embodiment of FIG. 16, the lens assembly 20 includes a lens mount 84, a lens 76, and a gasket 86. The gasket 86 is positioned in a lower rim 61 of the base 14 and the lens 76, and the lens mount 84 is positioned over the lens 76 and connected to the base 14. One or more openings are provided in the lens mount 84 for receiving fasteners to connect the lens mount 84 to the base 14. The lens mount 84 includes an inner rim 88 and has a first side 90 and a second side 92. The first or second side 90, 92 can alternatively face out from the luminaire to receive the different lenses. For example the first side 90 faces out to attach the SAG lens 76 as shown in FIG. 16 and to attach the flat lens 82 as shown in FIG. 17. The lens mount 84 second side 92 faces out to attach the drop lens 78 as shown in FIG. 18 and to attach the conical drop lens 80 as shown in FIG. 19. In an exemplary embodiment the first side 90 is smooth and the second side 92 is ribbed, knurled, or contains other surface texture features.

FIGS. 20-24 show exemplary embodiments of mounting components for use with the luminaire 10. The mounting components can include a pendant cover 100 and a mounting hub 102. The top of the cover 12 can include a recessed portion 104 having a groove 106 to receive a gasket 108 and the pendant cover 100 to provide a smooth transition and substantially flush surface with the cover 12. The pendant cover 100 includes an opening surrounded by a raised boss 110. The interior of the opening can have an internal thread and a set screw 112 can extend through the raised boss 110 and into the opening.

Figure 21:
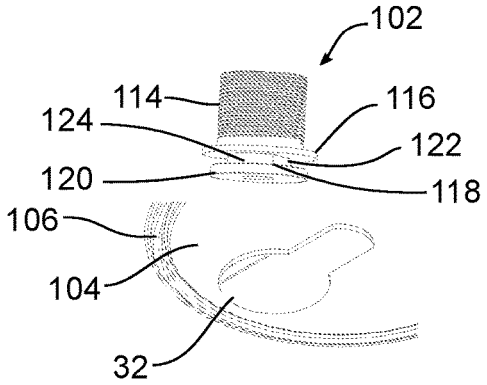
FIG. 21 is an enlarged view of a mounting hub and a cover opening.

As best shown in FIG. 21, the hub 102 includes a threaded portion 114, an upper flange 116, an engaging member 118, and a lower flange 120. The threaded portion 114 can include an interior thread as well as an exterior thread. The engaging member 118 can include a set of flat sides 122 and a set of curved sides 124. An opening extends through the hub 102 to allow conductors to pass through the hub 102 into the cover 12. The lower flange 120 is sized to fit through the circular opening in the key-hole 32, while the upper flange 116 is larger than the circular opening. After the lower flange 120 is through the circular opening, the hub 102 is moved so that the engaging member 118 enters the slot of the key-hole 32. The pendant cover 100 can then be threadably connected to the hub 102.

Figure 22:
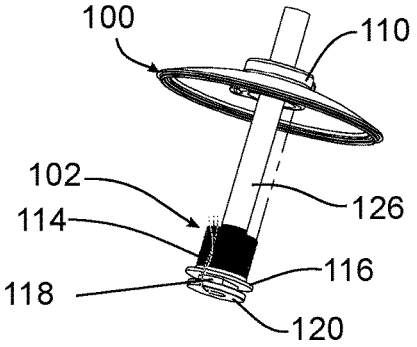
FIG. 22 is a perspective view of the mounting hub and a pendant cover connected to a support.
Figure 23:
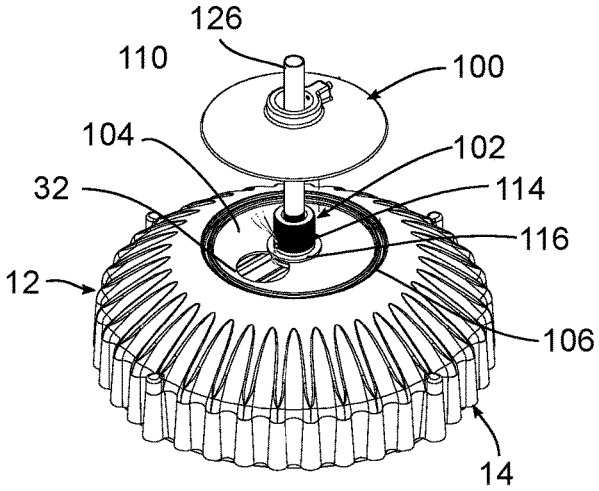
FIG. 23 is a perspective view of the mounting hub, pendant cover, and support of FIG. 22 connected to the luminaire.

FIGS. 22 and 23 show a mounting assembly that includes a support 126 for hanging the luminaire 10 above an area. The support 126 is shown as a hollow cylindrical post or cable that acts as a conduit for one or more conductors. The pendant cover 100 is placed around the support 126 and the hub 102 is connected to the support 126, for example through external threads on the support 126 and internal threads on the hub 102. The luminaire housing is then positioned near the hub 102 and the lower flange 120 inserted through the opening so that the flat sides 122 of the engaging member 118 are aligned with the flat sides of the key-hole slot 32. The hub 102 is then slid into the key-hole slot 32 and the pendant cover 100 is threadably connected to the hub 102. The set screw 112 can then be tightened to engage the support 126.

Figure 24:
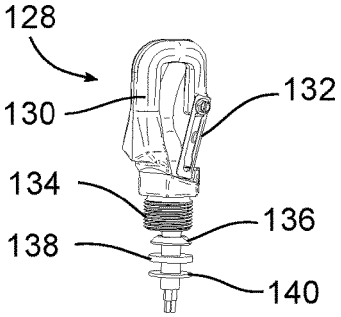
FIG. 24 is a perspective view of an exemplary hook mount.

FIG. 24 shows an alternative mounting component utilizes a hook mount 128. The hook mount 128 includes a body 130 with a C-shaped portion and a gate 132 biased into a closed position. The body 130 includes a threaded member 134 at least partially surrounding an opening for receiving a conductor. A cord grip ring 136, a rubber bushing 138, and a washer 140 extend from the opening in the hook mount 128. The hook mount 128 is threadably connected to the hub 102 and the luminaire can be connected to a support.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a cover having an outer wall, a first set of corrugations, and an interior recess, wherein the outer wall includes an opening;

a control component positioned in the interior recess;

a base connected to the cover having a second set of corrugations corresponding to the first set of corrugations, the base and cover forming a housing;

a light emitter connected to the base and operatively connected to the control component; and one or more mounting components for connecting the housing to a support and wherein the opening is configured to directly receive the support to position the housing over an area.

2. The luminaire of claim 1, wherein the mounting components include a mounting hub releasably connected to the cover and a pendant cover releasably connected to the cover.

3. The luminaire of claim 2, wherein the opening is a key-hole opening and the mounting hub connects to the key-hole opening.

4. The luminaire of claim 3, wherein the mounting hub includes an upper flange, a lower flange, and an engaging member positioned between the upper flange and the lower flange, wherein the lower flange is smaller than the upper flange.

5. The luminaire of claim 4, wherein the engaging member includes a curved side and a linear side.

6. The luminaire of claim 2, wherein the mounting hub includes an internal thread and an external thread.

7. The luminaire of claim 1, wherein the base includes a first portion and a second portion separated from the first portion, wherein the second portion receives the light emitter and a conductor extends through an opening between the first portion and the second portion to operatively connect the light emitter to the control component.

8. The luminaire of claim 1, wherein a bracket directly connects the control component to the cover.

9. The luminaire of claim 1, further comprising a lens assembly connected to the base, the lens assembly comprising a lens and a lens mount, wherein the lens mount is connectable to the base in a first orientation and a second orientation.

10. The luminaire of claim 1, wherein the base includes a recessed first portion, a second portion opposite the first portion, and an opening providing communication between the first portion and the second portion, and a conductor extending through the opening and operatively connecting the light emitter to the control component.

11. The luminaire of claim 10, wherein the base includes a protrusion extending from the first portion toward the cover.

12. The luminaire of claim 10, wherein the light emitter is a curved LED board.

13. The luminaire of claim 10, wherein the control component includes a driver.

14. The luminaire of claim 10, wherein a bracket mounts the control component to the cover.

15. The luminaire of claim 10, wherein the cover includes a key-hole opening and a mounting hub connectable to the key-hole opening.

16. A luminaire comprising:

a cover having an outer wall and a first set of corrugations;

a base connected to the cover having a second set of corrugations corresponding to the first set of corrugations, the base and cover forming a housing;

a control component positioned in the housing;

a light emitter connected to the base and operatively connected to the control component; and a lens assembly including a lens and a lens mount connecting the lens to the base, wherein the lens mount is configured to connect to the base in a first orientation for connecting a first style of lens and to connect to the base in a second orientation for connecting a second style of lens different from the first style.

17. The luminaire of claim 16, wherein the lens mount includes a stepped rim and a first side for mounting the first style of lens and a second side for mounting the second style of lens.

18. The luminaire of claim 16, wherein the base includes a first portion and a second portion separated from the first portion, wherein the second portion receives the light emitter and a conductor extends through an opening between the first portion and the second portion to operatively connect the light emitter to the control component.

19. The luminaire of claim 16, wherein the cover includes a key-hole opening and a mounting hub is connectable to the key-hole opening.

20. The luminaire of claim 19, wherein the mounting hub includes an upper flange, a lower flange, and an engaging member positioned between the upper flange and the lower flange, wherein the lower flange is smaller than the upper flange.

* * * * *